US008497446B1

(12) United States Patent
Glaser

(10) Patent No.: US 8,497,446 B1
(45) Date of Patent: Jul. 30, 2013

(54) ENCAPSULATED VACUUM INTERRUPTER WITH GROUNDED END CUP AND DRIVE ROD

(76) Inventor: Michael David Glaser, Brookfield, WI (US)

( * ) Notice: Subject to any disclaimer, the term of this patent is extended or adjusted under 35 U.S.C. 154(b) by 196 days.

(21) Appl. No.: 13/196,046

(22) Filed: Aug. 2, 2011

Related U.S. Application Data

(63) Continuation-in-part of application No. 13/012,176, filed on Jan. 24, 2011, now Pat. No. 8,471,166.

(51) Int. Cl.
*H01H 33/60* (2006.01)

(52) U.S. Cl.
USPC ..... 218/136; 218/153; 218/118

(58) Field of Classification Search
USPC ..... 218/153, 136, 118–120
See application file for complete search history.

(56) References Cited

U.S. PATENT DOCUMENTS

| | | | | |
|---|---|---|---|---|
| 3,178,542 | A | 4/1965 | Jennings | |
| 3,471,669 | A | 10/1969 | Curtis | |
| 3,814,882 | A * | 6/1974 | Harrold | 218/121 |
| 4,568,804 | A | 2/1986 | Luehring | |
| 4,618,749 | A | 10/1986 | Bohme et al. | |
| 4,871,888 | A | 10/1989 | Bestel | |
| 5,206,616 | A | 4/1993 | Stegmuller | |
| 5,387,772 | A | 2/1995 | Bestel | |
| 5,452,172 | A | 9/1995 | Lane et al. | |
| 5,917,167 | A | 6/1999 | Bestel | |
| 6,009,615 | A | 1/2000 | McKean et al. | |
| 6,153,846 | A * | 11/2000 | Morita et al. | 218/122 |
| 6,242,708 | B1 * | 6/2001 | Marchand et al. | 218/153 |
| 6,529,009 | B2 * | 3/2003 | Kikukawa et al. | 324/424 |
| 6,534,738 | B2 * | 3/2003 | Makino | 218/118 |
| 6,720,515 | B2 * | 4/2004 | Renz et al. | 218/136 |
| 6,723,940 | B1 | 4/2004 | Book et al. | |
| 6,747,234 | B2 | 6/2004 | Traska et al. | |
| 6,753,493 | B2 | 6/2004 | Rhein et al. | |
| 6,794,596 | B2 | 9/2004 | Rhein et al. | |
| 6,828,521 | B2 | 12/2004 | Steoving et al. | |
| 6,867,385 | B2 | 3/2005 | Stoving et al. | |
| 6,881,917 | B2 * | 4/2005 | Kikukawa et al. | 218/120 |
| 6,888,086 | B2 | 5/2005 | Daharsh et al. | |
| 6,946,614 | B2 | 9/2005 | McKean et al. | |
| 7,239,490 | B2 | 7/2007 | Benke | |
| 7,488,916 | B2 | 2/2009 | Muench et al. | |
| 2006/0016787 | A1 | 1/2006 | Stoving et al. | |
| 2006/0231529 | A1 | 10/2006 | Daharsh et al. | |

* cited by examiner

*Primary Examiner* — Truc Nguyen
(74) *Attorney, Agent, or Firm* — Donald J. Ersler

(57) ABSTRACT

An encapsulated vacuum interrupter with grounded end cup and drive rod is disclosed. The double break vacuum interrupter includes a first contact system including an annular stationary contact which is engaged by a primary moving contact with the moving contact drive rod extending through the primary moving contact and through the opening of the annular stationary contact. A second contact system includes a secondary moving contact placed on the end of the moving contact rod, which engages and operates a floating contact, which moves along the same axis. A mechanical adjustment system is provided for the floating contact. A coaxial moving contact drive rod system is provided. With the encapsulated vacuum interrupter, the lower portion of the vacuum envelope is insulated from the current path, which allows for the elimination of the long internal cavity in the encapsulation as the lower end cup of the vacuum envelope may be grounded.

19 Claims, 10 Drawing Sheets

ENCAPSULATED VACUUM INTERRUPTER WITH GROUNDED END CUP AND DRIVE ROD

CROSS-REFERENCES TO RELATED APPLICATIONS

This is a continuation-in-part patent application taking priority from nonprovisional application Ser. No. 13/012,176 filed on Jan. 24, 2011 now U.S. Pat. No. 8,471,166.

BACKGROUND OF THE INVENTION

1. Field of the Invention

The present invention relates to the field of high voltage vacuum switches and circuit interrupting devices and more particularly to an encapsulated vacuum interrupter with a grounded lower end-cup and drive rod, which allows an actuating mechanism to be mounted in close proximity to the vacuum module.

2. Discussion of Prior Art

Encapsulated vacuum switchgear is used to interrupt and control the flow of power through high voltage distribution circuits. As used here, the term "high voltage" refers to a voltage greater than 1000 volts. The encapsulated vacuum switchgear typically includes a vacuum interrupter encapsulated in an epoxy housing mounted to a cabinet or tank for the operating mechanism. The vacuum interrupter includes a pair of contacts, one stationary and one movable between an open and closed position to open and close the electrical circuit. The movable contact is typically mounted on the end of a drive rod, which moves the movable contact between the open and closed position.

The operating rod typically extends from the vacuum interrupter to engage an actuating mechanism mounted in an external cabinet or tank. The portion of the operating rod extending from the vacuum interrupter is insulated to prevent the flow of high voltage electrical energy from the vacuum interrupter to the actuating mechanism cabinet. The actuating cabinet of the actuating mechanism is usually grounded.

The epoxy housing typically includes an internal cavity for supporting the vacuum interrupter and the operating rod. The shape of the internal cavity must be designed to prevent high voltage electrical energy from bridging the gap between the vacuum interrupter and the actuating mechanism cabinet. The high voltage energy will bridge the gap by either "tracking" along the internal wall of the cavity formed in the housing or by striking the actuating mechanism cabinet directly through the cavity.

Tracking is a phenomena resulting from contamination or moisture forming on the internal cavity walls which allows electrical current to creep along the surface of the internal cavity wall from the high potential of the vacuum interrupter to the grounded actuating mechanism cabinet. The electrical current results in heating which over time will degrade the electrical insulating properties of the epoxy insulation and can result in eventual failure. Tracking can be minimized by increasing the distance that the electrical current must creep to reach the grounded actuating mechanism cabinet. Increasing the distance from the vacuum interrupter to the actuating mechanism frame results in a large switchgear device, which is undesirable as it adds cost and requires more space for installation.

U.S. Pat. Nos. 4,568,804; 5,452,172; 6,747,234; 6,828,521 B2; 6,888,086 B2; 7,488,916 B2 and U.S. Pat Application Publication 2006/0231529 A1 disclose several prior art methods of encapsulation that utilize a cavity. These devices utilize techniques such as insulating foam, convoluted cavity walls or semi-conductive coatings to reduce voltage stress or baffles and insulating plugs to increase the path over which current must track down the walls of the cavity. All of these devices are attempts to deal with the high voltage stresses within the internal cavity and they still result in switchgear that is unnecessarily large and still subject to dielectric breakdown of the cavity over time.

U.S. Pat. Nos. 3,471,669, 4,618,749, 5,206,616 and 7,239,490 B2 disclose devices that that have an actuating mechanism in close proximity or in direct contact with the vacuum interrupter. This renders the actuating mechanism at or near same potential as the end of the vacuum interrupter from which the operating rod exits. Such devices must then be fully encapsulated and protected by a grounded metal casing or mounted within another device that has a grounded metal casing to protect the operator from exposure to high voltage. Another device which actually has an exposed electrically hot mechanism housing is demonstrated by U.S. Pat. Nos. 6,753,493 B2 and 6,794,596 B2. This device is meant to be operated in a manner similar to an expulsion fuse and therefore must always be operated by an insulated hook stick in order to prevent the operator from contacting high voltage.

U.S. Pat. No. 6,723,940 B1 discloses a device that utilizes SF6 gas within the internal cavity and depends on the fact that SF6 gas has a higher dielectric strength than air to reduce the size of the internal cavity. However, SF6 gas insulated switchgear can leak over time and SF6 gas has been know to adversely affect the environment as it can affect the ozone layer.

Another interrupting device uses an external air insulated drive rod to eliminate the cavity as demonstrated in U.S. Pat. No. 6,946,614 B2. This design is more complex than those that utilize an internal cavity and quite large due to the clearances required in air.

Still another device utilizes a vacuum interrupter with an internal ceramic contact rod to operate a cantilever beam moving contact and electrically isolate the lower end cup of the vacuum interrupter. This type of device, which is disclosed by U.S. Pat. Nos. 3,178,542 and 5,387,772 does eliminate the need for the internal cavity in the encapsulation and does result in a more compact switchgear unit. However, the ceramic contact rod is exposed to the impact stresses created during closing and the tensile loads created when breaking contact welds upon opening and is therefore subject to breakage.

While the aforementioned prior art arrangements may be suitable for their intended use in accordance with their respective defined applications, as discussed hereinbefore, it would be desirable to provide an encapsulated vacuum interrupter with a grounded lower end-cup and actuating rod.

SUMMARY OF THE INVENTION

Accordingly, it is the principal object of the present invention to provide an encapsulated vacuum interrupter module with a grounded lower end cup and drive rod to allow the elimination of the need for an elongated cavity in the encapsulation, so that the actuator may be installed in close proximity to the vacuum module.

This patent application hereby incorporates in its entirety, U.S. patent application Ser. No. 13/012,176 to Glaser. The double break contact structure is required as this eliminates the need for a current exchange on the moving contact drive rod, which allows the lower end-cup of the vacuum interrupter to be electrically isolated or grounded. In the practice of the invention, the primary contact system has an annular stationary contact, which is engaged by a disc shaped moving contact. Both contacts are preferably fabricated of a copper-tungsten material, if the interrupter is designed for switching duty or a chromium-copper material, if the interrupter is designed to interrupt fault currents. The contacts may be of the butt style, transverse magnetic field or axial magnetic field designs as used in prior art. The base of the stationary contact is supported between two tubular insulators, which are preferably made of ceramic and form the main portion of the interrupter housing. One of these insulators contains the first contact system. The end of this insulator is closed off by an end cup preferably fabricated from stainless steel or monel, which has an opening for the moving contact rod and insulating system. A bellows preferably fabricated from stainless steel is connected from the inner diameter of the lower end cup to an annular moving internal insulator to allow motion of the moving internal insulator relative to the end cup and to seal the vacuum envelope. The annular moving internal insulator is preferably fabricated from ceramic. The other end of the moving internal insulator is connected to an internal end cup and a moving shield, which prevents vapors created during the interruption process from contacting the moving internal insulator. The moving shield is preferably fabricated from stainless steel and the internal end cup is preferably fabricated from stainless steel or monel. The internal end cup is attached to a contact rod, which has steel reinforcing rod. The contact rod is preferably fabricated from copper and the reinforcing rod is preferably fabricated from stainless steel. The reinforcing rod has a threaded portion that extends beyond a lower end of the moving contact rod to facilitate the connection of a capacitive voltage divider contact drive rod. The capacitive voltage divider contact drive rod is attached to the reinforcing rod, after brazing of the vacuum envelope. In this way, the capacitive voltage divider contact rod directly drives the moving contact rod, which eliminates the application of excessive forces to the moving internal ceramic insulator to protect it from breakage. The moving contact rod is attached to the disc shaped moving contact for the primary contact system. The moving contact rod also extends through the moving contact disc and annular stationary contact into the region of the second insulator. A second moving contact disc is mounted on the end of the moving rod and is engaged by a floating contact disc, mounted on a floating contact rod. The second moving contact disc and the floating contact disc are preferably fabricated from copper-tungsten or chromium-copper material and the floating contact rod is preferably fabricated from copper with a stainless steel reinforcing rod. The floating contact rod is mounted on the other end of the second insulator using a bellows and end-cup arrangement to allow sealing and free motion of the floating contact disc. The floating contact disc is driven by the motion of the second moving contact, which is directly coupled to the first contact system.

A mechanism is mounted on the end cup that supports the floating contact and allows the tolerance accumulation of the components to be adjusted out and the floating contact positioned so that the second moving contact and floating contact can be close just before the primary contacts. The mechanism also has the capability of controlling the range of motion of the floating contact so that it may be contacted by the second moving contact at approximately the same time the primary contacts close.

The mechanism includes an annular housing with two long slots along the main axis placed 180 degrees apart. The length of these slots is preferably the sum of the diameter of the holes in the adjuster described below plus the full range of tolerance accumulation of all parts that determine the spacing between the primary and secondary contacts.

The mechanism has the capability of adjusting out the tolerance build-up in the system. The housing also has an internal thread to allow the insertion of the adjuster. The moving contact rod for the floating contact has a cross-hole placed in a position to allow the adjuster move through its required range within the housing. A fixture pin placed in a through hole in the contact rod of the floating contact and passes through both slots formed through the housing. In this manner, when the interrupter is processed through a brazing cycle, the relationship between the contact rod and housing is established and the housing can also be used as a bellows anti-twist device. After the interrupter is brazed, the fixture pin is removed and an annular adjuster with external thread is screwed into the housing. The adjuster has six holes spaced 60 degrees apart, perpendicular to the main axis and of a diameter that is calculated to provide a small amount of over travel (approximately 1/32 inch) to accommodate any erosion or compression of the primary contacts due to interruption duty and repeated impact upon closing. The adjuster also has a counter-bore into which a compression spring or series of Bellville washers may be inserted. With the primary contacts held together, the adjuster is rotated so that the bottoms of the holes are below the cross-hole in the moving contact rod by the planned contact wear allowance. The multiple holes in the adjuster allow for a finer adjustment in determining this setting. Once the adjustment is complete, a pin is inserted, so that it passes through the housing, contact rod and adjuster and is secured with retaining rings at both ends. A compression spring or a series of Bellville type washers of appropriate design provide the required contact pressure for the secondary contacts and return force for the floating contact is placed in the counter-bore of the adjuster and is secured in place with a threaded cap. This forces the pin through the contact rod to the lower portion of the adjuster cross-holes and establishes the setting so the secondary contacts engage at approximately the same time as the moving contacts.

A portion of the moving contact rod extends through the cap and captures the compression springs to which a flexible lead or other current exchange method (garter springs, multi-lam current transfer devices or the like) may be attached. As the primary contact rod moves to the closed position, it can be seen that the secondary contacts will engage just before the primary moving contact engages the stationary contact. No current exchange is needed for the main contact rod as electric current flows from the stationary contact of the primary contact set to the moving contact, up the contact rod and through the secondary contacts and out the top terminal of the interrupter. As noted above, a capacitive voltage divider contact drive rod is connected to the threaded portion of the contact rod reinforcement. This drive rod includes an epoxy glass tube into which is inserted a system of capacitors and resistors which form a capacitive voltage divider to balance the voltage between the two contact systems as to provide more efficient interruption of the electric current. The capacitive voltage divider also serves to grade the voltage uniformly to ground. The capacitive voltage divider drive rod is positioned along the axis of the module and is coaxial with respect to the internal insulators and all internal contact structures. Epoxy is used to fill the gap between the external contact drive rod and the inner diameter of the internal insulator for improved dielectric performance. The capacitive voltage divider drive rod is used to connect to the drive mechanism for the encapsulated vacuum module. The lower end of the capacitive voltage divider drive rod as well as the lower end cup of the vacuum module are isolated from the main current path and may be grounded, eliminating the need for the elongated cavity required in prior art encapsulations.

The vacuum switch or interrupter above is prepared for encapsulation by the addition of a housing over the upper portion of the vacuum module which prevents the encapsulation material from contacting the moving components of the adjuster mechanism. The housing includes a metallic cylinder with a top fabricated from an insulating material. Portions of the housing are held in place by screws that engage insulators, which are secured to studs that are brazed to the end-cup of the interrupter. A flexible lead transfers current from floating contact rod to a terminal, which extends from a top of the housing. A terminal rod extends from the stationary contact. This configuration may be encapsulated using the various techniques established in prior art. Because the lower end cup on the vacuum module and the lower portion of the capacitive voltage divider drive rod are grounded, the encapsulation may be mounted directly to a drive mechanism and housing without concern about possible dielectric failure of the internal cavity in prior art encapsulations.

In another embodiment of the double break vacuum switch, the space formerly occupied by the internal cavity may be utilized to install an actuator within the encapsulation. The actuator has a flange at the bottom that allows it to be mounted onto a shoulder formed in the cavity in the encapsulation described above. In this way if issues arise during manufacture or use, the actuator may be replaced or salvaged, resulting in reduced scrap costs. When the actuator mechanism is mounted in the encapsulation, an extension rod and adapter is threaded onto the capacitive voltage divider drive rod to allow tolerance accumulation to be adjusted out, so that a slot in the adapter can be made to align with a cross hole in the portion of the plunger that extends below the drive mechanism. The extension rod and adapter also serve to place the vacuum module and actuator at ground potential. A flanged cover preferably fabricated from steel is placed over the end of the plunger that contains a contact pressure spring within and engages an external opening spring with the flanged portion. The cover has a cross-hole there through; so that it may be lined up with the slot in the adapter and the cross-hole in the plunger. A pin is placed through these three components and also through a pair of external linkages. The linkages extend down from the drive mechanism and also extend down to a chamber that contains a manual operating handle, contact position indicator, counter, electronic control board for a drive mechanism and electrolytic capacitors to energize the opening and closing coils. These items are contained in a housing attached to the lower portion of the encapsulation. The configuration described above eliminates the dielectric problems with the cavity under the vacuum module in prior art encapsulations resulting in a much more compact and cost effective switchgear unit.

A further ramification of the invention provides for the coaxial alignment of the primary and secondary contact systems as indicated in US Patent Application No. 13012176. In this case the primary moving contact is cup shaped and the moving contact rod extends through the primary moving contact just far enough so the face of the primary and secondary moving contacts lie in the same plane. The moving contact rod for the floating contact is extended far enough so it passes through the primary stationary contact to the point that the floating contact and the primary stationary contact lie in approximately the same plane. The adjustment mechanism described above would be utilized so that the floating contact and secondary moving contacts engage approximately 1/32 of an inch before the primary contacts. As state above, this allows for any wear of the primary contacts due to interruption duty or yielding of the contact rod due to repeated impact upon closing. The contacts again may be of the butt style, transverse magnetic field or axial magnetic field designs as used in prior art. Axial magnetic field contacts employed in this invention will actually produce a coaxial magnetic field and yield a more effective interruption due to the cancellation of magnetic fields outside the contact structure. The stationary contact may also have a cup shape to stabilize the arc at the outside contact ring and eliminate the expulsion of plasma from the interruption into the contact shield.

DESCRIPTION OF THE PREFERRED EMBODIMENTS

Figure 1:
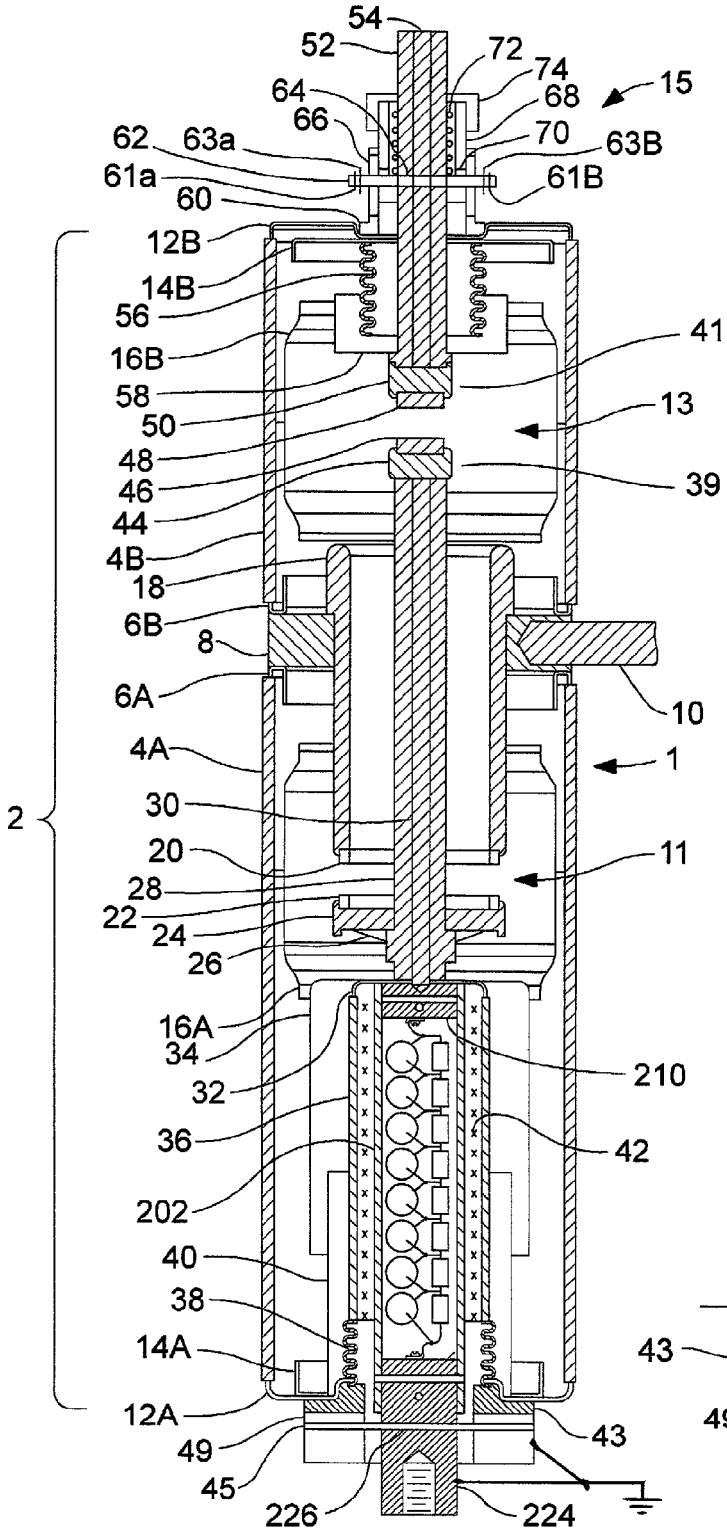
FIG. 1 is a cross-sectional view of a vacuum interrupter with a grounded lower end cup and drive rod in accordance with the present invention.
Figure 1A:
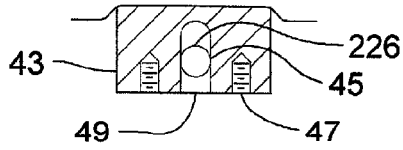
FIG. 1*a* is an enlarged cross-sectional view of a bellows anti-twist housing of a vacuum interrupter with a grounded lower end cup and drive rod in accordance with the present invention.

The encapsulated vacuum interrupter with grounded lower end cup and drive rod utilizes a double break vacuum switch 1 shown in FIG. 1, which comprises a vacuum envelope 2. The vacuum envelope 2 includes a pair of insulating cylinders 4A and 4B preferably made of alumina ceramic joined end-to-end by way of two triple point shields 6A and 6B preferably fabricated from stainless steel or monel and a stationary contact support ring 8 preferably fabricated from copper. A threaded hole in the stationary contact support ring 8 allows the attachment of a terminal rod 10 preferably fabricated from copper to facilitate electrical connection to the source line. The opposite ends of the ceramic cylinders are enclosed by two end cups 12A and 12B preferably fabricated from stainless steel or monel. A second set of triple point shields 14A and 14B are attached to the two end cups 12A and 12B. A generally tubular internal shield 16A and 16B preferably fabricated of stainless steel is provided within each insulating cylinder 4A and 4B, spaced from the interior wall and overlapping the triple point shields 6A and 6B to prevent any vaporized material from contacting the interior wall.

A primary contact system 11 includes an annular stationary contact support 18 preferably made of copper and attached to the stationary contact support ring 8. An annular stationary contact 20 preferably made of copper tungsten is attached to the lower end of the stationary contact support 18. The stationary contact support 18 is engaged by an annular moving contact 22 also preferably made of copper tungsten. The moving contact 22 is attached to a disc shaped moving contact support 24 preferably made from copper, reinforced by a moving contact reinforcement cone 26 preferably made from stainless steel with both being attached to a moving contact rod 28 preferably made from copper. The moving contact rod 28 is reinforced by a reinforcing rod 30 preferably fabricated of stainless steel and the end of the reinforcing rod 30 is threaded and extends beyond the lower end of the moving contact rod 28. An end cup 32 preferably made from stainless steel or monel and a tubular shield 34 preferably fabricated of stainless steel is attached to the end of the contact rod 28 and centered over the protruding reinforcing rod 30. A tubular moving internal insulator 36 preferably made from alumina ceramic is attached to the end cup 32. The opposite end of the moving insulator is attached to a bellows 38 preferably made from stainless steel, which is sealingly attached to the inside diameter of the end cup 12A. A second tubular shield 40 preferably made from stainless steel is also attached to the inside of end cup 12A. The shields 34 and 40 protect the outside diameter of the moving internal insulator 36 from deposition of conductive metallic vapors that would reduce its insulating properties and protects the bellows 38 from damage. In order to drive the contact rod 28, a capacitive voltage divider contact rod 202, described in detail below, is attached to the reinforcing rod 30. The end of the capacitive voltage divider contact rod 202 connected to a stud is equipped with a threaded adapter 210 preferably made from steel to allow attachment to the stud. With reference FIGS. 5-6, the opposite end of the capacitive voltage divider contact rod 202 is equipped with a threaded adapter 224 to allow attachment to an actuator mechanism 402 or 500 described below. Once the capacitive voltage divider contact rod 202 is tightened onto reinforcing rod 30, the space between the capacitive voltage divider contact rod 202 and the inner diameter of the moving internal insulator 36 is filled with epoxy 42 for improved dielectric performance. It is critical that the filling operation for epoxy 42 is controlled so that no epoxy 42 is deposited on the bellows 38. A bellows anti-twist housing 43 preferably fabricated from stainless steel is attached to the opposite side of end cup 12A and is centered by the circular depression formed in the end cup 12A. The bellows anti-twist housing 43 is indexed to the moving contact rod 202 by a pin 45 preferably made from nickel plated hardened steel, which passes through a cross-hole 226 in the capacitive voltage divider contact rod 202 and slides in a slot 49 in the bellows anti-twist housing 43. Two threaded holes 47 are formed into the bellows anti-twist housing 43 to facilitate the attachment of a housing 126 described below.

Figure 2:
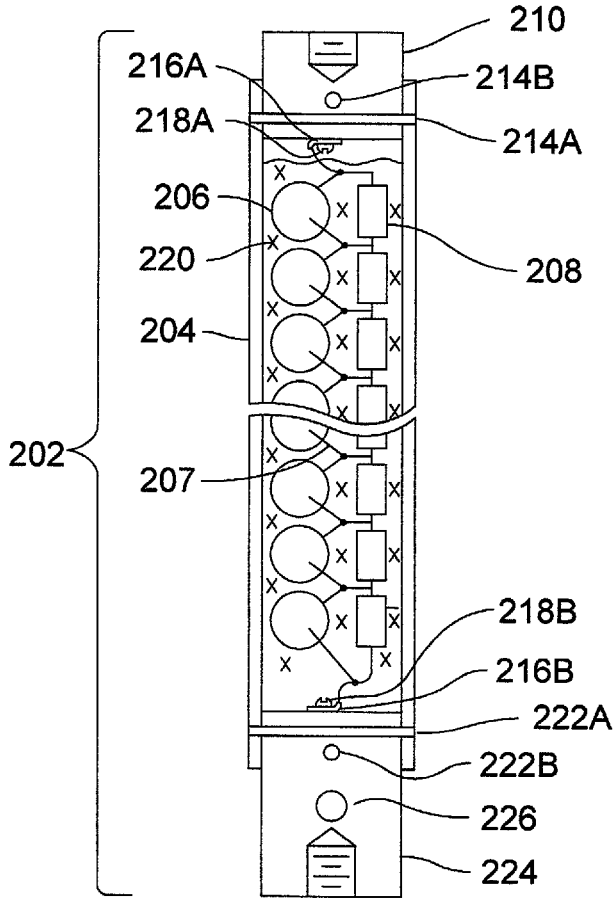
FIG. 2 is a front view of a capacitor-resistor voltage divider of a vacuum interrupter with a grounded lower end cup and drive rod in accordance with the present invention.

The double break vacuum switch requires a capacitor-resistor voltage divider 207 to distribute the voltage equally between the two contact gaps during interruption and to grade the high voltage to zero in the region of the lower end-cup 12A so that the end-cup 12A and a connected actuator mechanism 402 or 500 may be grounded; as shown in FIG. 2, which is provided by an capacitive voltage divider contact rod 202. Capacitive voltage divider contact rod 202 preferably includes a filament wound epoxy glass insulating tube 204 of sufficient diameter to allow the insertion of a 500 pf 30 kV disc capacitor 206 connected in parallel with a 20 Meg-ohm 2 watt carbon resistor 208. A sufficient number of these capacitor-resistor units are connected in series on the inside of the insulating tube 204 to withstand the impulse voltage requirements of the voltage rating that the vacuum switchgear is designed for. The capacitor-resistor units are connected to a top of the insulating tube 204 with an adapter 210 preferably made from steel, which is pinned to the insulating tube 204 with roll pins or groove pins 214A and 214B preferably made from steel and preferably has a tin plated brass terminal 216A attached with a tin plated steel screw 218A to allow connection of one end of a capacitor-resistor network 207. The lengths of the insulating cylinder 4A and the internal insulator 36 are designed so that the lower portion of the capacitor-resistor network 207 rests in the area of the bellows 38 and the end-cup 12A. In this way the voltage stress will be graded to near zero in the area of the end-cup 12A as the lower portion of the capacitor resistor network 207 is grounded via its connection to the actuating mechanism 402 or 500. The insulating tube 204 is filled with an epoxy 220 to improve dielectric characteristics. A preferable steel adapter 224 is pinned to the other end of the insulating tube 204 with roll pins or groove pins 222A and 222B preferably made from steel and has a preferably tin plated brass terminal 216B attached with a tin plated steel screw 218B to allow connection of the lower portion of the capacitor-resistor network 207. The adapter 224 includes a cross-hole 226 to allow insertion of a pin 45 to index with the slot 49 in the bellows anti-twist housing 43, described previously. However, the capacitor-resistor voltage divider 207 would not be necessary when used with voltages lower than about 17 KV. A space in the insulating tube 204 created by the removal of the capacitor-resistor network 207 would be filled with the epoxy 220 to prevent arcing therein.

Referring back to FIG. 1 the second contact system 13 includes an extension of moving contact rod 28, which passes through the moving contact support 18. The aforementioned extension is attached to a preferable disc-shaped copper moving contact support 44 and a moving contact disc 46 preferably made from copper tungsten, which together form a second moving contact 39. The second moving contact 39 engages a floating contact 41, which includes a floating contact disc 48 preferably made from copper-tungsten and a preferable disc-shaped copper floating contact support 50. The floating contact support 50 is attached to a floating contact rod 52 preferably made from copper, which is reinforced by a reinforcing rod 54 preferably made from stainless steel and sealingly passed through end cup 12B and triple point shield 14B by a preferable stainless steel bellows 56. The bellows 56 is protected from damage by vaporized material by a preferable stainless steel bellows shield 58. A mechanism housing 60 preferably made from stainless steel is attached to the opposite side of end cup 12B and is centered by a circular depression formed in the end cup 12B. The mechanism housing 60 is indexed to the floating contact rod 52 by a preferable nickel plated hardened steel pin 62, which passes through a cross-hole 64 in the floating contact rod 52 and slides in a slot 66 in the bellows mechanism housing 60.

During the brazing cycle for the vacuum switch, pin 62 is replaced by a preferable stainless steel fixture pin to assure the alignment of the parts.

An operating mechanism for floating contacts 15 includes the mechanism housing 60 into which is threaded a preferable brass adjuster 68. The mechanism housing 60 has two slots 66 located at opposite sides around its circumference. The adjuster 68 has six holes 70 equally spaced around its perimeter, so that the pin 62 can be inserted into any opposite facing pair of holes 70 during an adjustment process. When threading the adjuster 68 into the mechanism housing 60, the pin 62 is withdrawn from the mechanism housing 60. The adjuster 68 is positioned, so that the center of one pair of holes 70 line-up with the center of the cross-hole 64 in the floating contact rod 52 and the top of the pair of holes 70 are preferably 0.031 inch above cross-hole 64. During the adjustment, both the first and second set of contacts must be closed. The pin 62 is then inserted back through the mechanism housing 60, the adjuster 68 and the floating contact rod 52. The pin 62 is held in place by a preferable pair of steel retaining rings 61A and 61B and a pair of steel washers 63A and 63B. A compression spring 72 preferably made of music wire is inserted into a counter-bore in the adjuster 68 and a preferable threaded nickel plated steel spring retainer 74 is tightened. This forces the pin 64 to the bottom of the pair of holes 70. The diameter of the pair of holes 70 in the adjuster is preferably 0.062 larger than the diameter of the cross hole in floating contact rod 52 to provide for an allowance for contact wear. The slots 66 in the mechanism housing 60 have a minimum length equal to the tolerance build-up between the location of the cross-hole 64 in floating contact rod 52 and the end of the moving contact disc 46 plus the diameter of the holes 70 in the adjuster 68. This allows the adjuster 68 to be able to be adjusted through the full range of possible locations of cross-hole 64.

Figure 3:
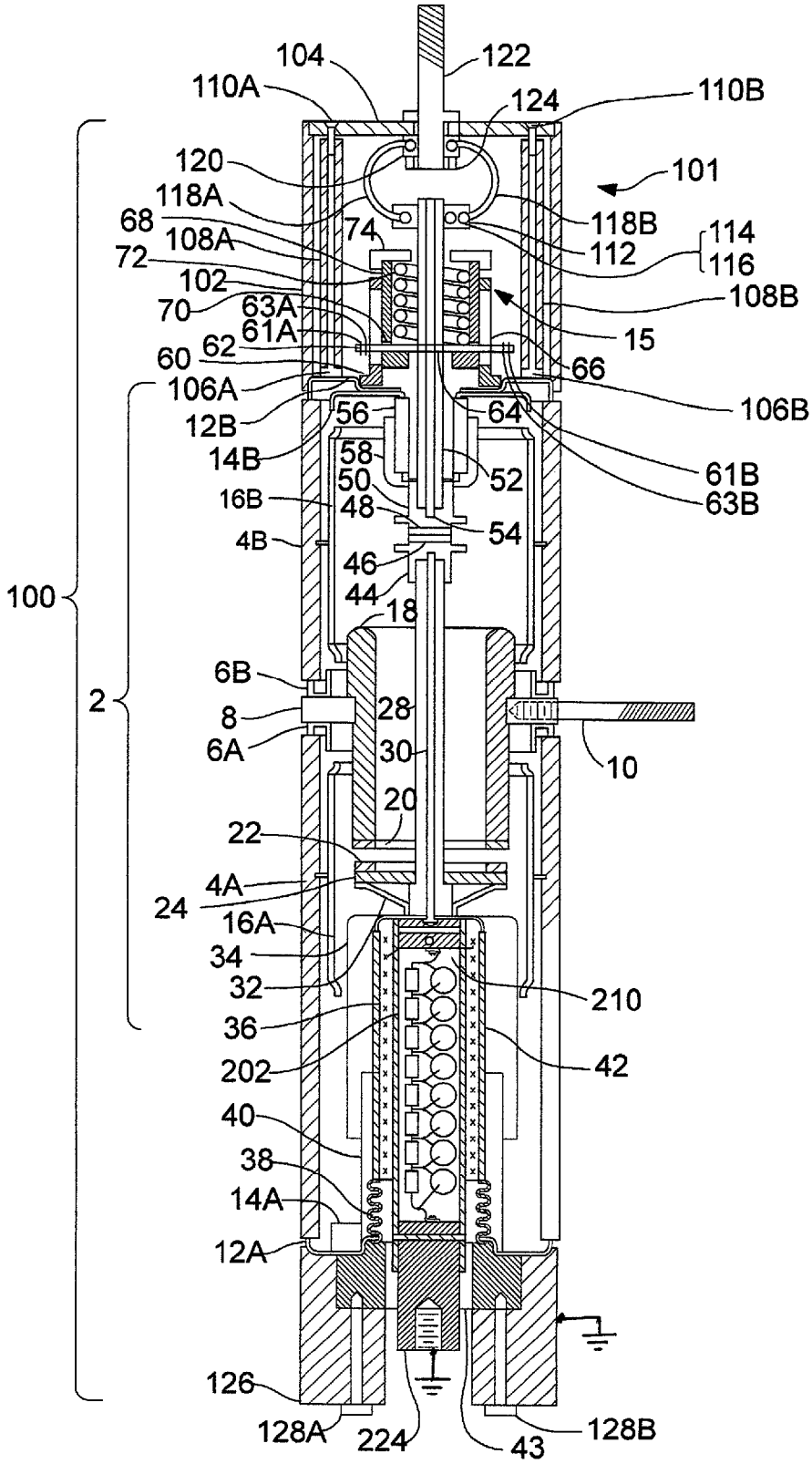
FIG. 3 is a cross-sectional view of a vacuum interrupter with a grounded lower end cup and drive rod prepared for encapsulation in accordance with the present invention.

In order to facilitate encapsulation, a module 100 is created by placing a protective enclosure 101 over the mechanism 15 at the top end of the vacuum envelope 2 as shown in FIG. 3. The mechanism includes a preferable aluminum external mechanism housing 102 and a cover 104 which may be made of an insulating material such as GP01 or GP03 fiberglass or G10 epoxy glass. A preferable pair of stainless steel studs 106A and 106B is attached to the outside surface of end cup 12B. An insulating stringer 108A and 108B preferably made of filament wound epoxy glass is threaded onto each stud 106A and 106B and a preferable stainless steel screw 110A and 110B is threaded into the opposite end of each stringer 108A and 108B to retain the cover 104 and the external housing 102. A split-clamp connector 112 preferably made of copper is tightened onto the end of floating contact rod 52 using a bolt 114 and nut 116. Preferably, a pair of highly flexible multi-stranded copper conductors 118A and 118B are crimped to a preferable copper split clamp connector 112 and to a terminal connector 120. The terminal connector 120 is threaded onto the lower portion of a source terminal 122 and secured with a jam nut 124, creating a current exchange between the floating contact rod 52 and the source terminal 122. The opposite end of the vacuum envelope 2 is prepared for encapsulation by the installation of a housing 126 preferably fabricated from a thermoset plastic over the bellows anti-twist housing 43 and securing with a pair of stainless steel bolts 128A and 128B.

Figure 4:
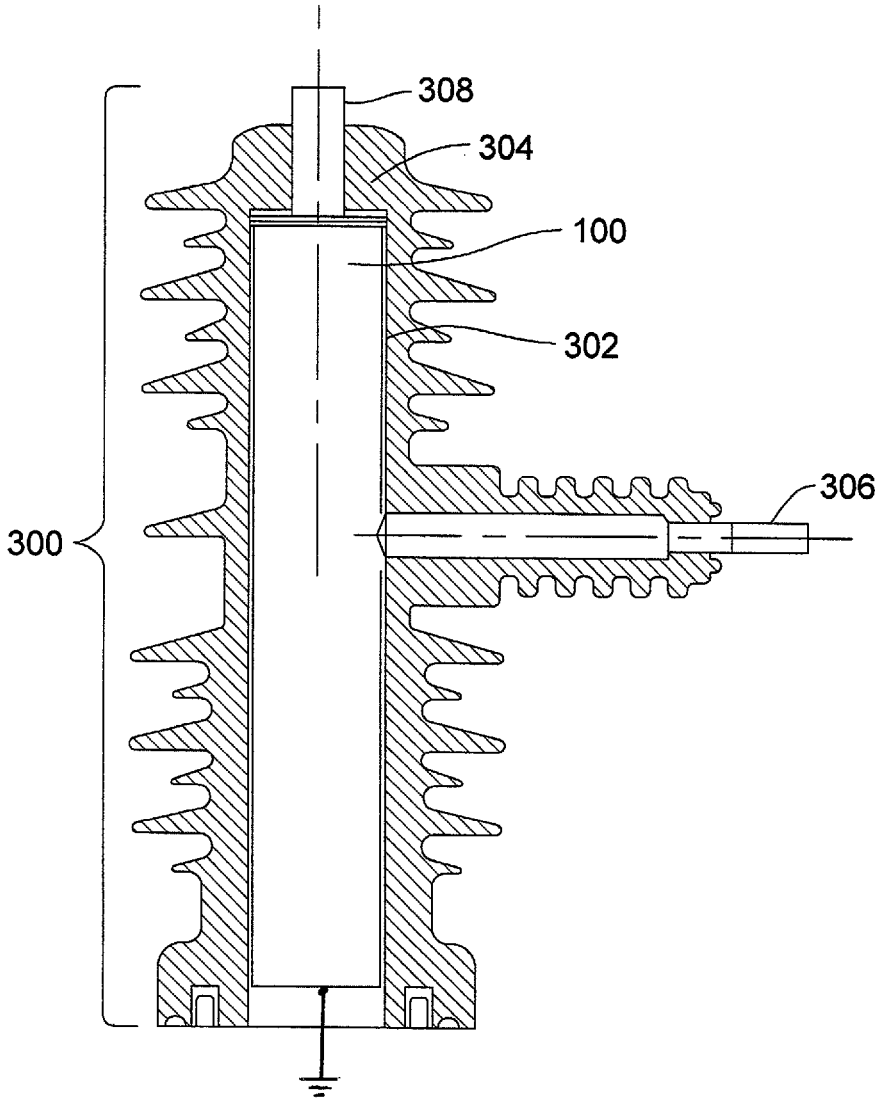
FIG. 4 is a cross sectional view of a two terminal encapsulated vacuum interrupter with a grounded lower end cup and drive rod in accordance with the present invention.
Figure 5:
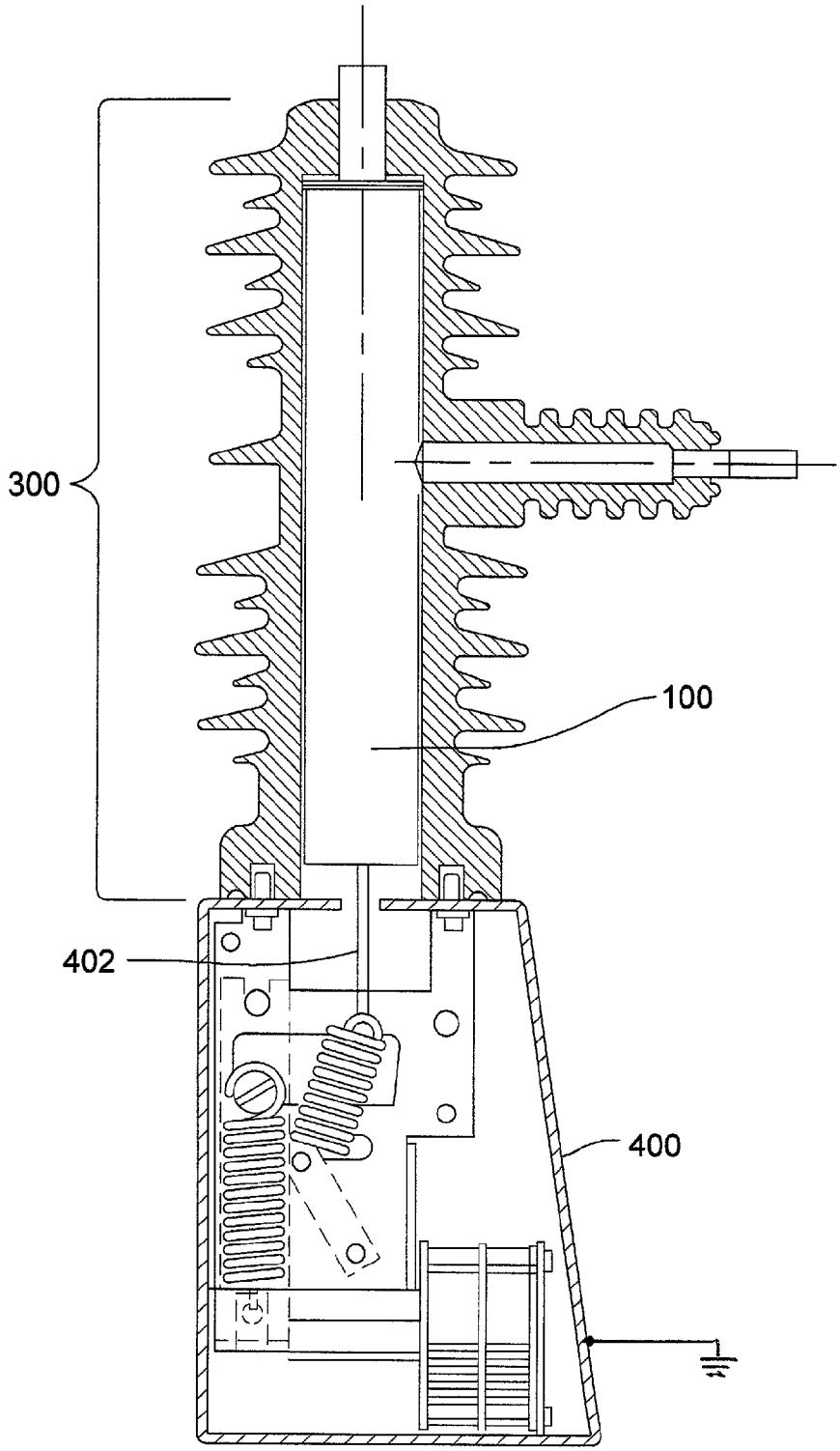
FIG. 5 is a cross-sectional view of a two terminal encapsulated vacuum interrupter with a grounded lower end cup and drive rod mounted on top of a housing containing an actuating mechanism in accordance with the present invention.

There are several examples of prior art, which show the encapsulation of vacuum modules. FIG. 4 indicates one possible way of encapsulating the aforementioned vacuum module as demonstrated by U.S. Pat. No. 5,917,167. In this case, the module 100 is encased in a preferable silicone rubber tube 302 and cast in an epoxy encapsulation 304. The result is a two terminal encapsulation 300 with a source terminal 306 and a load terminal 308. The encapsulation 300 is then mounted on top of a housing 400 preferably made of steel, which contains the actuating mechanism 402 as shown in FIG. 5.

In operation, the encapsulated vacuum interrupter 300 would be coupled via capacitive voltage divider contact rod 202 to an actuating mechanism 402. The closing stroke of the mechanism 402 and capacitive voltage divider contact rod 202 would drive the moving contact rod 28 upward. Because the moving internal insulator 36 is coupled to the moving contact rod 28 by the end cup 32, the moving internal insulator 36 moves in unison with the moving contact rod 28. In this way, the capacitive voltage divider contact rod 202 directly drives the moving contact rod 28 which eliminates the application of excessive impact forces to the moving internal ceramic insulator 36 to protect it from breakage when the contacts close. Because of the aforementioned adjustment of the mechanism adjuster 68, when the spring 72 is installed, the pin 62 is forced to the bottom of the pair of holes 70 which causes the floating contact rod 52 to be pushed forward 0.031 inch. This causes the second set of contacts 46 and 48 to engage slightly in advance of the first set of contacts 20 and 22. As the moving contact rod 28 continues its closing stroke, the floating contact rod 52 is driven upward resulting in the pin 62 moving upward in hole 70 and compressing spring 72. The closing stroke is completed when moving contact rod 28 is driven to the point that the first set of contacts 20 and 22 mate, which results in the pin 62 being centered in the hole 70. At this point, the electric current flows from the source terminal 306 through the first set and second of contacts and directly out the load terminal 308.

Upon initiation of the opening stroke, the moving contact rod 28 moves downward causing the first set of contacts 20 and 22 to immediately part and initiate an arc. Because the moving internal insulator 36 is coupled to the moving contact rod 28 by the end cup 32, the moving internal insulator 36 again moves in unison with the moving contact rod 28. In this way, the capacitive voltage divider contact rod 202 directly drives the moving contact rod 28, which eliminates the application of excessive tensile weld breaking forces to the moving internal ceramic insulator 36 to protect it from breakage when the contacts open. The energy stored in the spring 72 forces the floating contact rod 52 downward maintaining contact through the second set of contacts 46 and 48 for the first 0.031 inch of contact travel until the pin 62 is driven to the bottom of pair of holes 70. At this point, floating contact rod 52 is no longer able to follow the moving contact rod 28 downward and the second set of contacts 46 and 48 begin to part initiating a second arc. The capacitor-resistor network 207 contained in capacitive voltage divider contact rod 202 acts to distribute the voltage evenly across the two contact gaps resulting in an efficient interruption of the arc as the moving contact rod 28 completes its opening stroke and provides the full open gap for the first and second sets of contacts. Because the first and second sets of contacts are electrically connected in series, this results in a double break of the arc when the contacts open allowing the vacuum interrupter to be utilized at elevated voltages. The fact that pair of holes 70 are 0.062 larger than the pin allows +/−0.031 for wear of the contacts which may be unequally distributed between the first and second set of contacts.

Figure 6:
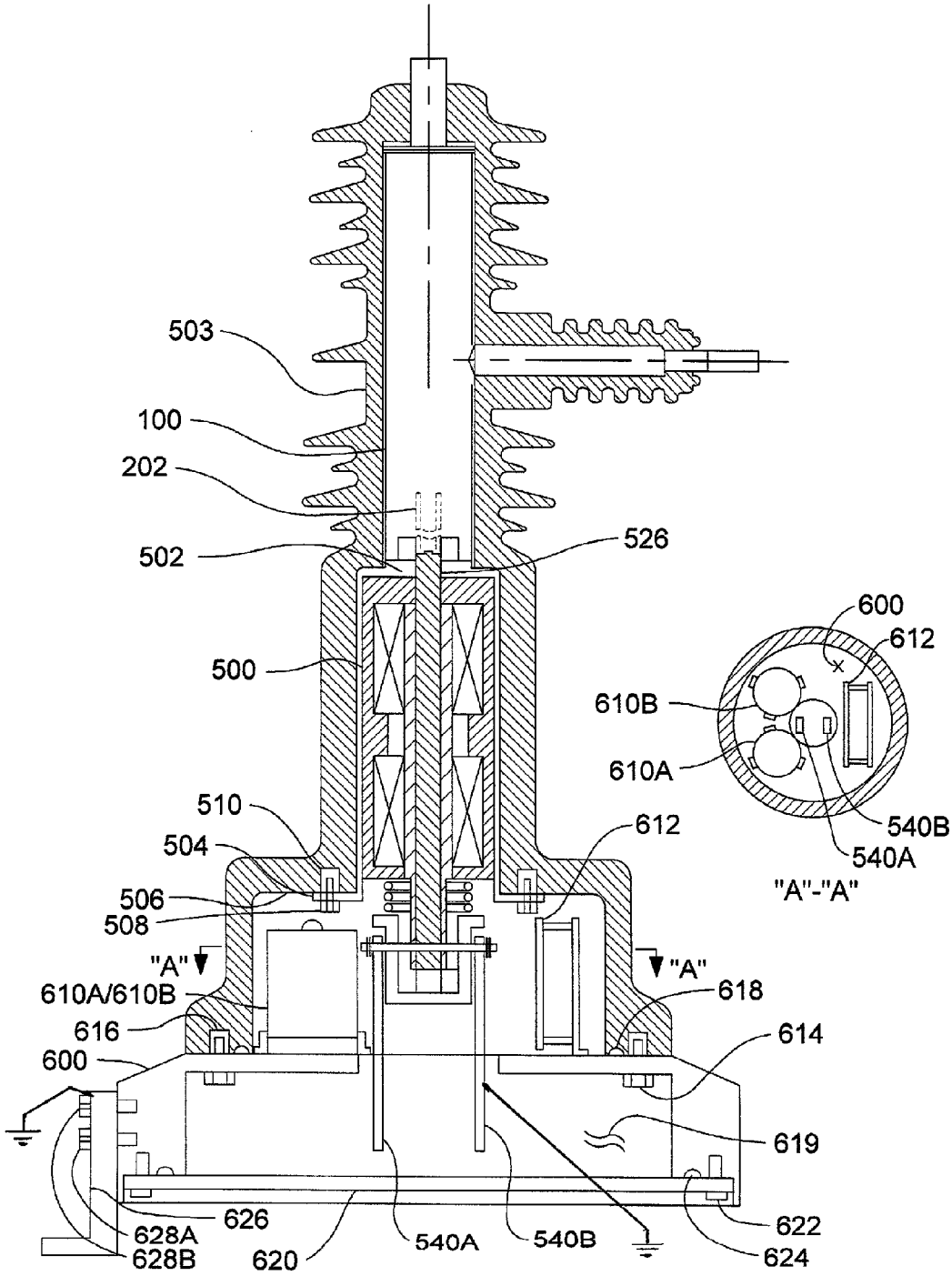
FIG. 6 is a cross-sectional view of a second embodiment of a two terminal encapsulated vacuum interrupter with grounded lower end cup and drive rod mounted to an actuator in accordance with the present invention.

With reference to FIG. 6, another embodiment of the encapsulated vacuum interrupter with grounded lower end cup and drive rod, an actuator 500 may be mounted in a space formerly occupied by an internal cavity to provide compact switchgear with the vacuum module and actuator within the same encapsulation. Because a lower end of the vacuum switch module 100 as well as the actuator 500 are at ground potential, the cavity formerly used to provide dielectric clearance can now be used to house actuator 500 as well as the other components necessary for the operation of the complete switchgear unit. To accomplish this, an enlarged chamber 502 is formed below the encapsulated vacuum module to allow for installation of the actuator 500. U.S. Pat. No. 6,009,615 provides an example of a bi-stable magnetic actuator, which would be preferred to be applied as the actuator 500. The actuator 500 would be provided with a plurality of mounting feet 504 at the lower end. This allows the mounting feet 504 to be attached to a shoulder 506 cast into the internal cavity of an encapsulation 503 utilizing a preferable plurality of steel bolts 508 threaded into a plurality of cast in threaded inserts 510.

Figure 7:
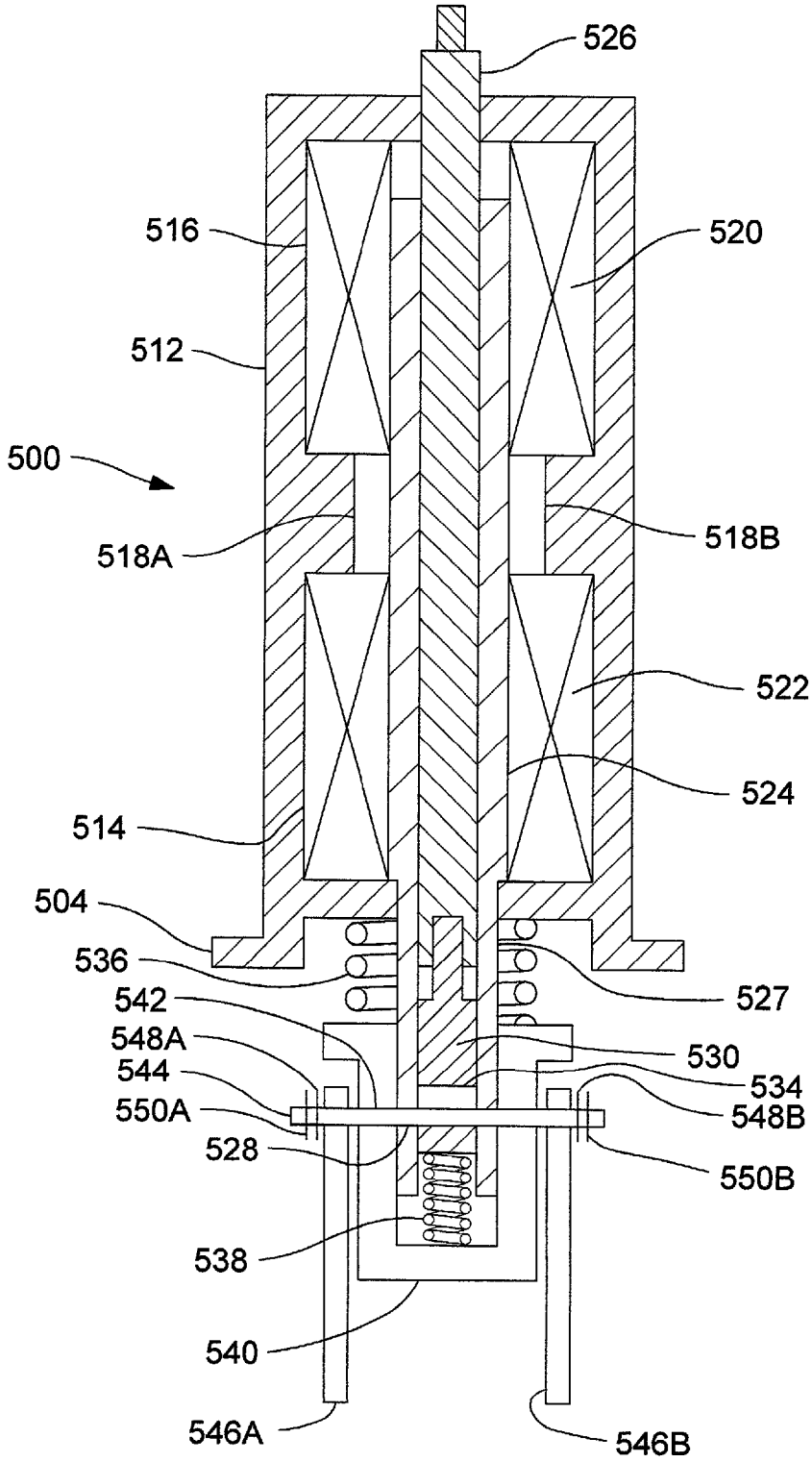
FIG. 7 is a cross-sectional view of an actuator to be utilized with an encapsulated vacuum interrupter with a grounded lower end cup and drive rod in accordance with the present invention.

With reference to FIG. 7, the actuator 500 contains a preferable laminated steel frame 512 divided into two sections 514 and 516, which serve as the magnetic circuit. A pair of permanent magnets 518A and 518B is attached to the portion of the magnetic circuit that separates the two sections 514 and 516. The permanent magnets 518A and 518B are preferably attached to the frame 512 with industrial adhesive in a way that the south pole for both magnets is oriented toward a center of the frame 512 and the north pole of both magnets is oriented toward an outside of the frame 512. A closing coil 520 is placed in chamber 516 and an opening coil 522 is placed in chamber 514 of the frame 512. Preferably, a "400 series" stainless steel plunger 524 is disposed within the open space of frame 512 and permanent magnets 518A and 518B in such a way that it can move from end to end within frame 512. The plunger 524 has a bore through its full length to allow for insertion of a preferable stainless steel extension drive rod 526 for connection to the capacitive voltage divider contact rod 202. The plunger 524 also has a necked portion 527 that extends through the lower end of frame 512 and contains a cross hole 528 to provide an attachment means to a preferable nickel plated steel threaded adjuster 530 attached to the extension drive rod 526. The adjuster 530 contains a slot 534 with a length designed to provide the desired contact pressure plus over travel distance. The threaded adjuster 530 is adjusted so that an upper edge of the slot 534 in the threaded adjuster 530 is preferably 1/32 inch above the top of the cross hole 528 in the neck 527 of plunger 524 when the primary contacts of the vacuum module 100 and the plunger 524 are in the closed position. An opening spring 536 is slid over the neck 527 of plunger 524 and a contact pressure spring 538 is placed into the bore of plunger 524. A preferable steel retaining cap 540 is pushed onto the neck 527 of the plunger 524 to the point that a cross-hole 542 in the retaining cap 540 lines up with the cross hole 528 in the neck 527 of plunger 524 and the slot 534 in threaded adjuster 530. A preferable nickel plated hardened steel pin 544 is inserted through cross-holes 542 and 528 and the slot 534 to secure these parts. When actuator 500 moves to the closed position, the movement of pin 544 in the slot 534 allows the retaining cap 540 to compress the contact pressure spring 538, providing contact pressure through adjuster 530 and extension drive rod 526 to the closed first and second contacts of vacuum module 100. An optional pair of linkages 546A and 546B may also be added to each side of the pin 544, which is retained by washers 548A and 548B and retaining rings 550A and 550B. The use of the optional linkages 546A and 546B is dependent on the final design of the switchgear unit as described below.

Referring back to FIG. 6, an aluminum or stainless steel enclosure 600 is mounted to the lower end of the encapsulation 503 to contain the remaining components required to complete the switchgear assembly. In this case, a pair of capacitors 610A and 610B and an actuator circuit board assembly 612 may be mounted on a top surface of a preferable aluminum enclosure 600, so that they fit in the cavity below the actuator 500. The enclosure 600 is attached to a lower end of the encapsulation 503 using a plurality of preferable stainless steel bolts 614 threaded into a plurality of cast in threaded inserts 616. An elastomer "o" ring seal 618 is provided to prevent moisture ingress at this point. The linkages 540A and 540B extend from the actuator into the enclosure 600 so that a manual operating means (not shown) as know in prior art may be provided for the completed switchgear unit. A space 619 is also provided in the enclosure for an operations counter, contact position indicator and a receptacle to allow connection of an external control. These items are well known in prior art and need not be shown. The lower portion of the enclosure 600 is closed off by an aluminum cover plate 620, which is held in place by a plurality of preferable stainless steel bolts 622. An elastomer "o" ring seal 624 is provided at this point to prevent the ingress of moisture. A mounting bracket 626 preferably made of galvanized steel is provided for the completed switchgear unit and is held in place by a pair of preferable stainless steel bolts 628A and 628B.

Figure 8:
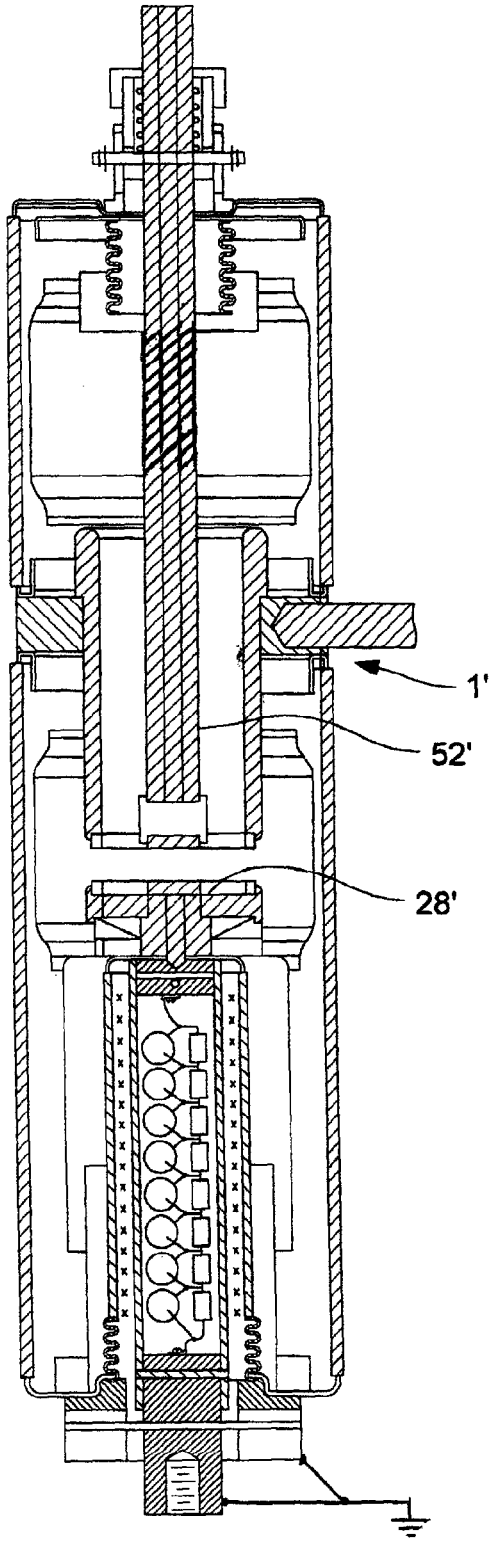
FIG. 8 is a cross-sectional view of a vacuum interrupter with a grounded lower end cup and drive rod modified to have a double break vacuum switch in accordance with the present invention.

In still another embodiment of the encapsulated vacuum interrupter with grounded end cup and drive rod 1', the contact structures may be modified as shown in U.S. patent application Ser. No. 13/012,176. A first modification of the double break vacuum switch with grounded end cup and contact rod 1' is shown in FIG. 8. In this case, the length of the moving contact rod 28' is reduced and the length of floating contact rod 52' is increased so both the first and second sets of contacts part in the same plane. This embodiment eliminates the passage of the moving contact rod 28' through the arc zone of the first set of contacts.

Figure 9:
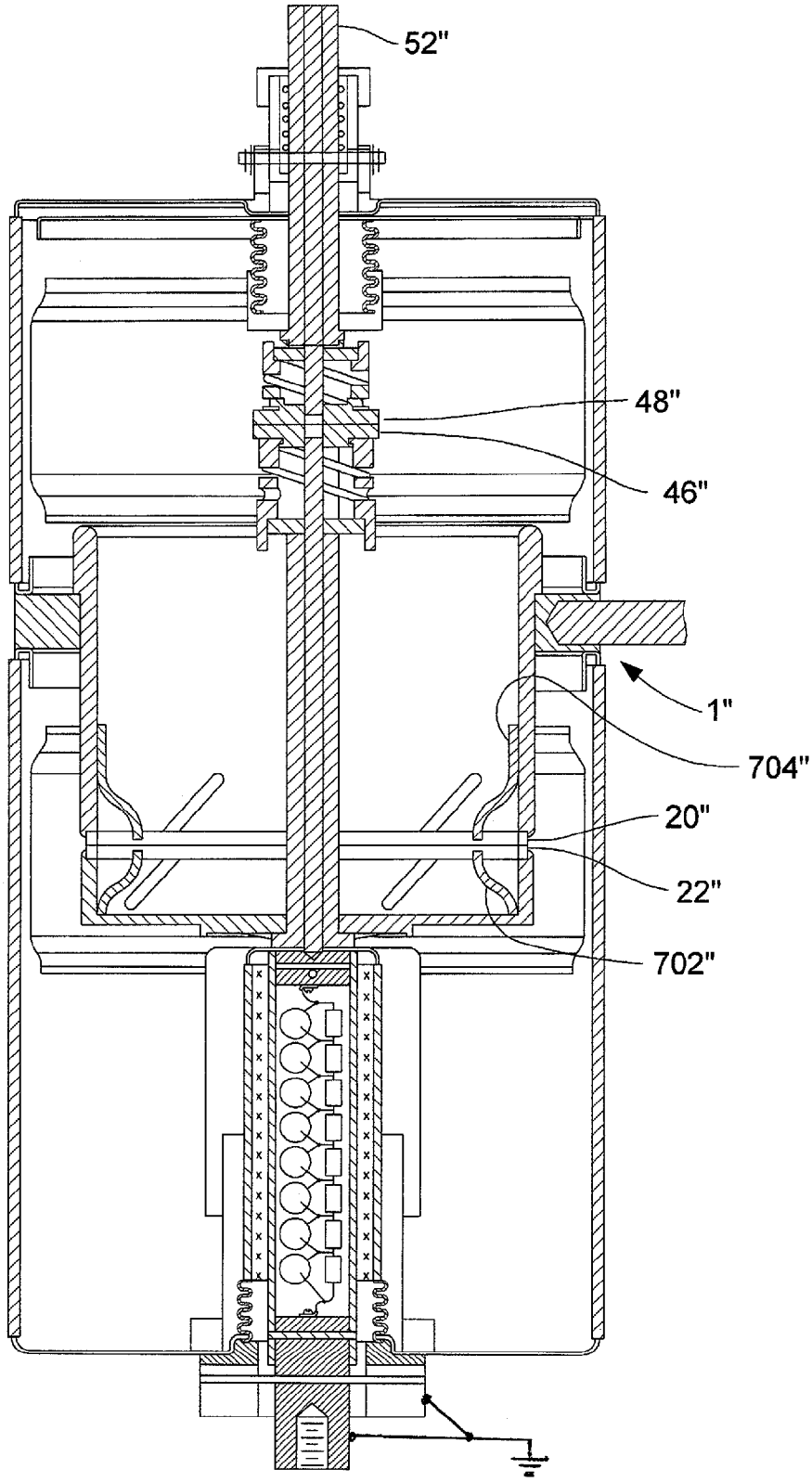
FIG. 9 is a cross-sectional view of a vacuum interrupter with a grounded lower end cup and drive rod having a second modification of a contact structure in accordance with the present invention.

FIG. 9 shows a second modification of the contact structure of the encapsulated vacuum interrupter with grounded end cup and drive rod 1". The annular stationary contact 20", the annular moving contact 22", the moving contact disc 46" and the floating contact 48" are preferably fabricated from copper chromium instead of copper tungsten utilizing any of the transverse or axial magnetic field contact structures shown in prior art. FIG. 9 shows one possible axial magnetic field contact structure as demonstrated by U.S. Pat. Nos. 4,871,888 and 6,867,385, and US Pat App No. 2006/0016787, which are hereby incorporated into this application by reference in their entirety. The double break vacuum switch 1" includes contact rods 28", 52". The revised contact structures convert the contacts 20", 22", 46" and 48" from switching duty to fault interrupting duty and results in a double break vacuum interrupter. Preferably, stainless steel reinforcing tubes 702" and 704" are provided to support the inside diameter of contacts 20" and 22".

Figure 10:
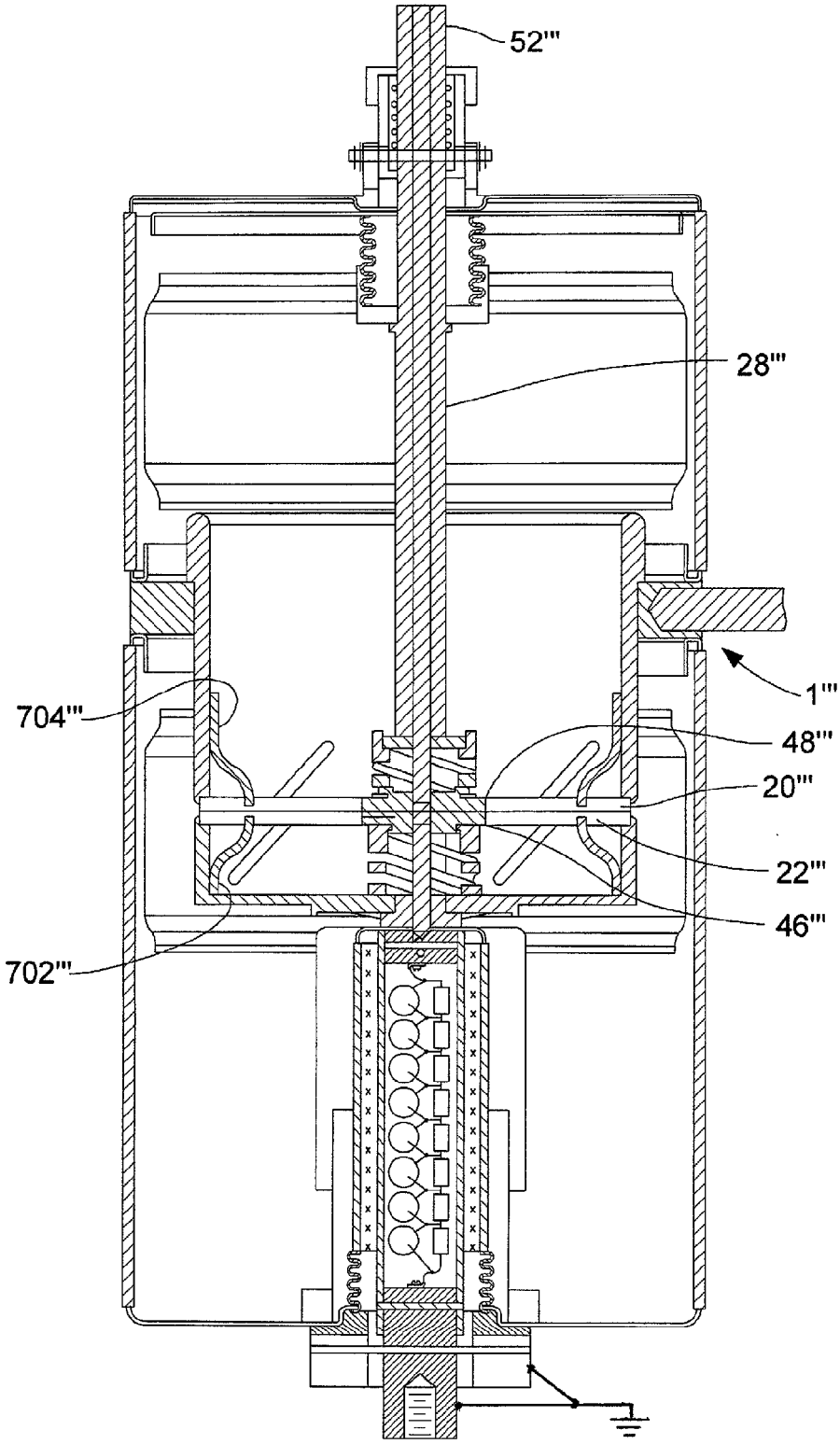
FIG. 10 is a cross-sectional view of a vacuum interrupter with a grounded lower end cup and drive rod having a third modification of a contact structure in accordance with the present invention.

FIG. 10 illustrates a third modification of the contact structure of the encapsulated vacuum interrupter with grounded end cup and drive rod 1' utilizing coplanar axial magnetic field contacts. In this case, the length of the moving contact rod 28''' is reduced and the length of the floating contact rod 52''' is increased, so both sets of axial magnetic field contacts 20''', 22''', 46''' and 48''' are in the same plane. In this embodiment the fields are coaxial and the interruption would benefit from the fact that in a coaxial electrical system, the fields of the two conductors cancel outside the enclosing conductor so that the effect outside magnetic fields is shielded from the central conductor. Stainless steel reinforcing tubes 702''' and 704''' are provided to support the inside diameter of contacts 20''' and 22'''.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A double break vacuum interrupter comprising:

a vacuum enclosure having a first end and a second end, said second end is opposite to said first end;

a first contact system includes a moving contact and a stationary contact, said stationary contact is retained inside said vacuum enclosure at substantially said first end thereof;

a second contact system includes a moving contact rod, a floating contact rod and a biasing means, said floating contact rod having a first rod end and a second rod end, said second rod end is opposite to said first rod end, said floating contact rod is slidably retained at said second end of said vacuum enclosure, said biasing means is retained on said second end of said vacuum enclosure, substantially said first rod end of said floating contact rod is retained by said biasing means, said second rod end of said floating contact rod is biased toward said first end of said vacuum enclosure, said moving contact is retained on one end of said moving contact rod, the other end of said moving contact rod is electrical isolated from said moving contact, the other end of said moving contact rod is grounded; and an actuator is retained at a bottom of said double break vacuum interrupter and attached to said moving contact rod.

2. The double break vacuum interrupter of claim 1, further comprising:

said double break vacuum interrupter is encapsulated in a solid dielectric insulation.

3. The double break vacuum interrupter of claim 1, further comprising:

said moving contact having an annular moving contact pad, said stationary contact having an annular shape, said stationary contact having an annular stationary contact pad.

4. The double break vacuum interrupter of claim 1, further comprising:

said biasing means includes a mechanism housing, a threaded adjuster, a compression spring and an end cap, said mechanism housing is secured to the other end of said vacuum enclosure, said threaded adjuster is threadably engaged with said mechanism housing, said threaded adjuster including a spring bore for receiving said compression spring, said end cap retaining said compression spring in said spring bore.

5. The double break vacuum interrupter of claim 4, further comprising:

at least two adjuster openings are formed through said threaded adjuster to receive an anti-rotation pin, at least two housing openings are formed through said mechanism housing to receive said anti-rotation pin and a hole is formed through said floating contact rod to receive said anti-rotation pin.

6. The double break vacuum interrupter of claim 1 wherein:

said contacts being at least one of butt type, transverse magnetic field and axial magnetic field.

7. A double break vacuum interrupter comprising:

a vacuum enclosure includes a first insulating cylinder and a second insulating cylinder, said first insulating cylinder is terminated with a first end cup, said vacuum enclosure having a first end and a second end, said second end is opposite to said first end;

a first contact system includes a moving contact and a stationary contact, said stationary contact is located inside said first insulating cylinder; and a second contact system includes a moving contact rod, a floating contact rod and a biasing means, said floating contact rod having a first rod end and a second rod end, said second rod end is opposite to said first rod end, said floating contact rod is slidably retained in said second insulating cylinder, said biasing means is retained on said second end of said vacuum enclosure, substantially said first rod end of said floating contact rod is retained by said biasing means, said second rod end of said floating contact rod is biased toward said first end of said vacuum enclosure, said moving contact is retained on one end of said moving contact rod, the other end of said moving contact rod is electrical isolated from said moving contact, said first end cup is grounded and the other end of said moving contact rod; and an actuator is retained at a bottom of said double break vacuum interrupter and attached to said moving contact rod.

8. The double break vacuum interrupter of claim 7, further comprising:

said double break vacuum interrupter is encapsulated in a solid dielectric insulation.

9. The double break vacuum interrupter of claim 7, further comprising:

said moving contact having an annular moving contact pad, said stationary contact having an annular shape, said stationary contact having an annular stationary contact pad.

10. The double break vacuum interrupter of claim 7, further comprising:

said biasing means includes a mechanism housing, a threaded adjuster, a compression spring and an end cap, said mechanism housing is secured to the other end of said vacuum enclosure, said threaded adjuster is threadably engaged with said mechanism housing, said threaded adjuster including a spring bore for receiving said compression spring, said end cap retaining said compression spring in said spring bore.

11. The double break vacuum interrupter of claim 10, further comprising:

at least two adjuster openings are formed through said threaded adjuster to receive an anti-rotation pin, at least two housing openings are formed through said mechanism housing to receive said anti-rotation pin and a hole is formed through said floating contact rod to receive said anti-rotation pin.

12. The double break vacuum interrupter of claim 7 wherein:

said contacts being at least one of butt type, transverse magnetic field and axial magnetic field.

13. The double break vacuum interrupter of claim 7 wherein:

an actuator is retained at a bottom of said double break vacuum interrupter and attached to said moving contact rod.

14. A double break vacuum interrupter comprising:

a vacuum enclosure having a first end and a second end, said second end is opposite to said first end;

a first contact system includes a moving contact and a stationary contact, said stationary contact is retained inside said vacuum enclosure at substantially said first end thereof;

a second contact system includes a moving contact rod, a floating contact rod and a biasing means, said floating contact rod having a first rod end and a second rod end, said second rod end is opposite to said first rod end, said floating contact rod is slidably retained at said second end of said vacuum enclosure, said biasing means is retained on said second of said vacuum enclosure, substantially said first rod end of said floating contact rod is retained by said biasing means, said second rod end of said floating contact rod is biased toward said first end of said vacuum enclosure, said moving contact is retained on one end of said moving contact rod, the other end of said moving contact rod is electrical isolated from said moving contact, the other end of said moving contact rod is grounded; and a capacitor-resistor voltage divider is connected in series between said one end of said moving contact rod and the other end of said moving contact rod.

15. The double break vacuum interrupter of claim 14, further comprising:

said double break vacuum interrupter is encapsulated in a solid dielectric insulation.

16. The double break vacuum interrupter of claim 14, further comprising:

said moving contact having an annular moving contact pad, said stationary contact having an annular shape, said stationary contact having an annular stationary contact pad.

17. The double break vacuum interrupter of claim 14, further comprising:

said biasing means includes a mechanism housing, a threaded adjuster, a compression spring and an end cap, said mechanism housing is secured to the other end of said vacuum enclosure, said threaded adjuster is threadably engaged with said mechanism housing, said threaded adjuster including a spring bore for receiving said compression spring, said end cap retaining said compression spring in said spring bore.

18. The double break vacuum interrupter of claim 17, further comprising:

at least two adjuster openings are formed through said threaded adjuster to receive an anti-rotation pin, at least two housing openings are formed through said mechanism housing to receive said anti-rotation pin and a hole is formed through said floating contact rod to receive said anti-rotation pin.

19. The double break vacuum interrupter of claim 14 wherein:

an actuator is retained at a bottom of said double break vacuum interrupter and attached to said moving contact rod.

* * * * *